US006332813B1

(12) United States Patent
Okabe et al.

(10) Patent No.: US 6,332,813 B1
(45) Date of Patent: Dec. 25, 2001

(54) JOINING STRUCTURE OF CONNECTOR

(75) Inventors: Toshiaki Okabe; Tetsuya Yamashita, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/631,105

(22) Filed: Aug. 1, 2000

(30) Foreign Application Priority Data

Aug. 2, 1999 (JP) ..... 11-219211

(51) Int. Cl.[7] ..... H01R 13/502
(52) U.S. Cl. ..... 439/701; 439/717; 439/541.5
(58) Field of Search ..... 439/701, 709, 439/712, 715, 717, 541.5

(56) References Cited

U.S. PATENT DOCUMENTS 4,425,018 * 1/1984 Stenz ..... 339/189
6,077,127 * 6/2000 Wu ..... 439/717

FOREIGN PATENT DOCUMENTS 11-312547 11/1999 (JP) .

* cited by examiner

*Primary Examiner*—Gary Paumen
*Assistant Examiner*—Alexander Gilman
(74) *Attorney, Agent, or Firm*—Finnegan, Henderson, Farabow, Garrett & Dunner, L.L.P.

(57) ABSTRACT

A joining structure of a connector is provided with one connector having a plurality of engaging portions and another connector having the same number of engaging portions as the number of a plurality of engaging portions in one connector, and a plurality of engaging portions in one connector and a plurality of engaging portions in another connector are mutually corresponded so as to form a plurality of engaging pairs. In this structure, a plurality of engaging portions in one connector and a plurality of engaging portions in another connector respectively have shapes so that the respective engaging portions can correspondingly engage with each other so as to form a plurality of engaging pairs in the case that one connector and another connector are joined in a proper direction, and at least one of pairs between a plurality of engaging portions in one connector and a plurality of engaging portions in another connector can not engage with each other in the case that one connector and another connector are joined in an improper direction.

12 Claims, 6 Drawing Sheets

JOINING STRUCTURE OF CONNECTOR

BACKGROUND OF THE INVENTION

The present invention relates to a joining structure of a connector, and more particularly to a joining structure between connectors in each of which a terminal portion of a wire harness is connected and arranged within a connector housing.

Conventionally, in order to improve a handling property of a plurality of connectors, there is proposed a joining structure of a connector for joining connectors to each other.

Such joining structure of the connector includes a structure using an engaging projection and an engaging groove.

SUMMARY OF THE INVENTION

In accordance with a consideration of the inventors of the present application, the joining structure of the connector includes a structure in which connectors 1 and 4 are joined and combined with each other by sliding a side surface 3 of a connector housing 2 in one connector 1 along a side surface 6 of a connector housing 5 in another connector 4, as shown in FIG. 8.

Illustration is omitted, however, a connection metal fitting is installed and arranged in the connector housing 2 and the connector housing 5. A terminal of a wire harness W is connected to the connection metal fitting, as shown in FIGS. 9 and 10.

The respective connectors 1 and 4 are structured such as to be connected to separately prepared connectors (not shown) so as to be electrically connected.

These connectors 1 and 4 are joined in accordance with an operation that two engaging portions 7 and 8 having the same shape and the same size and formed on the side surface 3 of one connector 1 along a height direction are engaged with two engaged groove portions 9 and 10 having the same shape and the same size and formed on the side surface 6 of another connector 4 along a height direction.

The connector 1 and the connector 4 are joined to each other in the manner as mentioned above, thereby intending to improve an arrangement and a mounting operation of the wire harness W.

The engaging portion 7 formed on the side surface 3 in one connector 1 side is constituted by a pair of engaging pieces 7A and 7B and the engaging portion 8 is constituted by a pair of engaging pieces 8A and 8B, as shown in FIG. 8. Further, the engaging pieces 7A and 7B constituting the engaging portion 7 are formed so as to protrude in an oblique direction mutually moving apart from the side surface 3. The engaging pieces 8A and 8B constituting the engaging portion 8 are protruded in an oblique direction mutually moving apart in the same manner.

The engaged groove portions 9 and 10 formed on the side surface 6 in another connector 4 side are structured such that the engaging portions 7 and 8 mentioned above are slid therealong and fitted thereto.

That is, both side walls of the engaged groove portions 9 are formed in an inverted taper shape, and are structured such as to be brought into contact with inner side surfaces (surfaces opposing to the side surface 3) of the engaging pieces 7A and 7B in a state of inserting the engaging portion 7. Further, both side walls of the engaged groove portion 10 are also formed in an inverted taper shape in the same manner, and are structured such as to be brought into contact with inner side surfaces (surfaces opposing to the side surface 3) of the engaging pieces 8A and 8B in a state of inserting the engaging portion 8.

Since two sets of engaging portions and engaged groove portions are formed in the manner mentioned above, in comparison with the case that one set of engaging portion and engaged groove portion are formed, it is possible to prevent the connectors 1 and 4 from being shaky and rickety between the both.

FIG. 9 is a schematic view showing a direction between the connectors 1 and 4 in which the connector 1 and the connector 4 can be suitably jointed. As shown in FIG. 9, in a normally joined state, the connectors land 4 are combined with each other so that the engaging portion 7 of the connector 1 corresponds to the engaged groove portion 9 of the connector 4 and the engaging portion 8 of the connector 1 corresponds to the engaged groove portion 10 of the connector 4.

However, in the joining structure of the connector mentioned above, since two joining portions 7 and 8 of the connector 1 have the same shape and the same size and the engaged groove portions 9 and 10 of the connector 2 have the same shape and the same size, the engaging portion 8 can engage with the engaged portion 9 and the engaging portion 7 can engage with the engaged portion 10, respectively in the case that the connectors 1 and 4 are inversely joined in a longitudinal direction, as shown in FIG. 10. Accordingly, it is preferable to suppose that an operator erroneously handle the direction of the connector.

Further, since in many cases, the operation of joining the connectors 1 and 4 mentioned above is performed in a narrow place where a state of the connectors 1 and 4 is hard to be recognized and it is hard to find an error in the joining direction, it is preferable to further employ any countermeasure.

Since it is hard to find the error in the joining direction when joining the connectors in which the wire harnesses W having different wiring directions are mounted to each other, the error is first found at a time of joining the combined connector to the separately prepared connector to be joined, so that a case giving a trouble to the operation can be supposed.

In the case of engaging the connectors with each other in the erroneous joining direction as mentioned above, it is necessary to take out both of the connectors and again rejoin them.

Accordingly, there is a problem that a smooth joining operation is hard to be performed in the case of the joining structure of the connector considered above.

Accordingly, an object of the present invention is to provide a joining structure of a connector in which connectors can be suitably and smoothly joined and an operability is improved.

In accordance with the present invention, there is provided a joining structure of a connector comprising: one connector having a plurality of engaging portions; and another connector having the same number of engaging portions as the number of a plurality of engaging portions in one connector, a plurality of engaging portions in one connector and a plurality of engaging portions in another connector being mutually corresponded so as to form a plurality of engaging pairs. In this structure, a plurality of engaging portions in one connector and a plurality of engaging portions in another connector respectively have shapes so that the respective engaging portions can correspondingly engage with each other so as to form a plurality of engaging pairs in the case that one connector and another connector are joined in a proper direction, and at least one of pairs between a plurality of engaging portions in one connector and a plurality of engaging portions in another connector can not engage with each other in the case that one connector and another connector are joined in an improper direction.

DETAILED DESCRIPTION OF THE PREFERRED EMBODIMENTS

A description will be in detail given below of each of embodiments of a joining structure of a connector in accordance with the present invention with reference to the accompanying drawings.

At first, a description will be in detail given below of a first embodiment of a joining structure of a connector in accordance with the present invention with reference to FIGS. 1 to 5.

Figure 1:
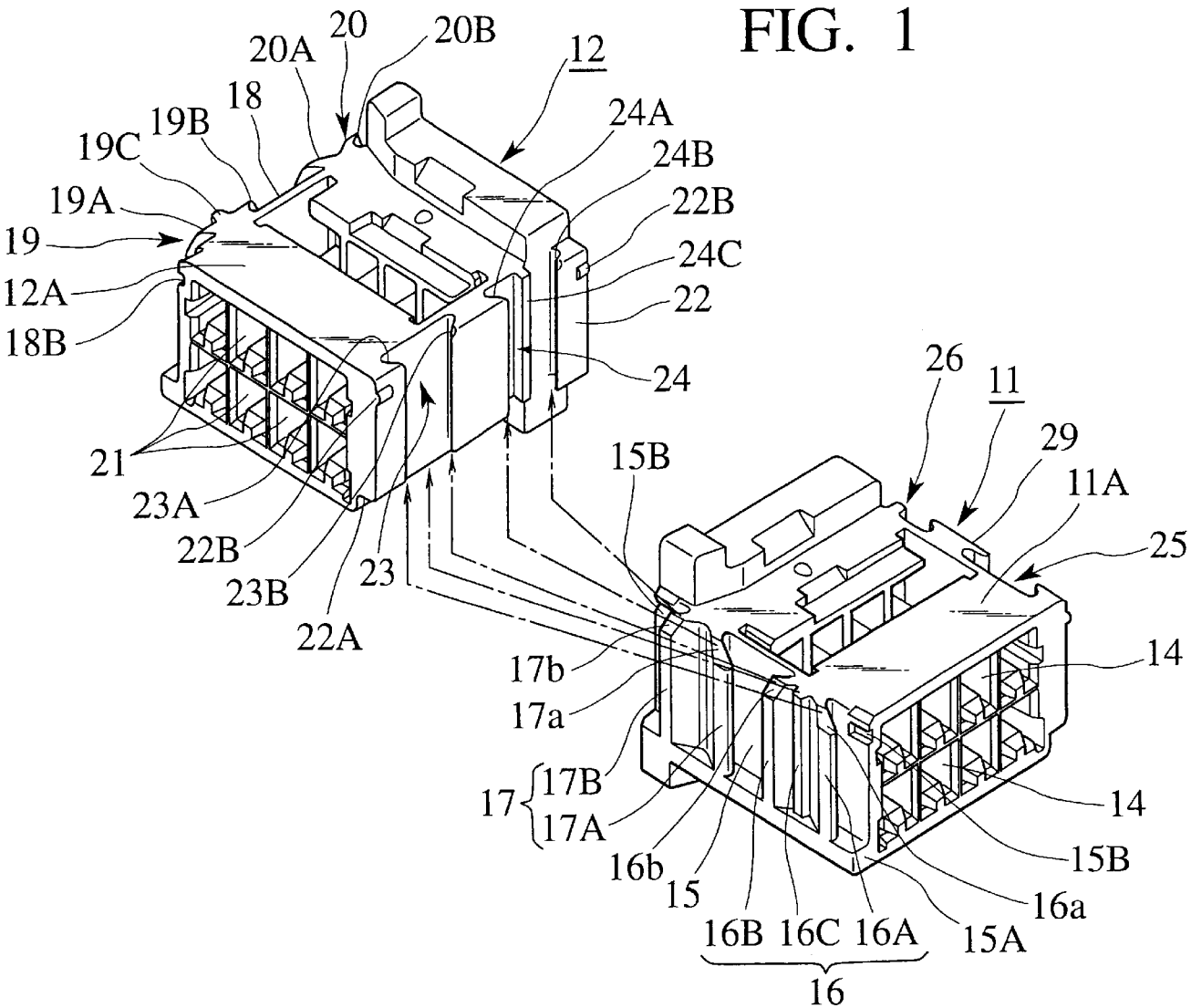
FIG. 1 is a perspective view explaining a joining state in a joining structure of a connector in accordance with a first embodiment of the present invention.

As shown in FIG. 1 showing a state before two connectors 11 and 12 having the same shape are combined, the connector 11 has a substantially rectangular parallelepiped-shaped connector housing 11A made of a synthetic resin having an electrically insulating property.

A plurality of terminal receiving chambers 14 are formed within the connector housing 11A in such a manner as to extend through from a front surface side to a rear surface side. Terminal metal fittings (not shown) for respectively joining ends of wire harnesses W (shown in FIGS. 2 and 3) are arranged and fixed within the terminal receiving chamber 14.

Engaging portions 16 and 17 corresponding to a joining projection are respectively formed on one side surface 15 of the connector housing 11A at a predetermined interval along a height direction of the connector housing 11A. The engaging portion 16 is formed so as to be positioned in a rear portion side on the side surface 15 of the connector housing 11A. Further, the engaging portion 17 is formed so as to be positioned in a front portion side on the side surface 15 of the connector housing 11A.

Here, a description will be given of a structure of the engaging portion 16.

The engaging portion 16 is constituted by two plate-like engaging pieces 16A and 16B formed so as to obliquely protrude in a different direction from each other (a forward direction and a backward direction) with respect to the side surface 15 in such a manner as to form a predetermined angle (for example, about 20 to 45 degrees), and an erroneous join prevention protruding portion 16C formed so as to protrude between the engaging pieces 16A and 16B.

The engaging pieces 16A and 16B and the erroneous join prevention protruding portion 16C are integrally formed in the connector housing 11A, and are made of the same synthetic resin as that of the connector housing 11A. The engaging pieces 16A and 16B are extended along a height direction of the connector housing 11A. Further, the erroneous join prevention protruding portion 16C is structured such as to protrude from a bottom portion of a groove formed between the engaging pieces 16A and 16B toward a side portion of the side surface 15 and is extended along the height direction of the connector housing 11A. Further, guiding taper surfaces 16*a* and 16*b* are formed in upper portions of the engaging pieces 16A and 16B.

Next, a description will be given of a structure of the engaging portion 17.

The engaging portion 17 is constituted by two plate-like engaging pieces 17A and 17B formed so as to obliquely protrude in a different direction from each other (a forward direction and a backward direction) with respect to the side surface 15 of the connector housing 11A in such a manner as to form a predetermined angle (for example, about 20 to 45 degrees).

The engaging pieces 17A and 17B are integrally formed in the connector housing 11A, and are made of the same synthetic resin as that of the connector housing 11A. The engaging pieces 17A and 17B are extended along a height direction of the connector housing 11A so as to have the same height as that of the engaging pieces 16A and 16B of the engaging portion 16. Further, guiding taper surfaces 17*a* and 17*b* are formed in upper portions of the engaging pieces 17A and 17B.

A step portion 15A having the same protruding size as a protruding size between the side surface 15 and front end surfaces of the engaging pieces 16A, 16B, 17A and 17B is formed in a lower portion of the side surface 15 on which the engaging portions 16 and 17 are formed. The step portion 15A has a positioning function for defining a mutual height position in a state of being joined to the connector 12 to be joined. Further, an engaging recess portion 15B is formed in each of upper portions of both sides of the side surface 15.

Next, a description will be given of a structure of the connector 12 joined to the connector 11.

As shown in FIG. 1, the connector 12 has the same shape as that of the connector 11 mentioned above. That is, in accordance with the present embodiment, two series of combination connectors and three series of combination connectors can be assembled by preparing plural sets of one kind of connectors.

The connector 12 has a connector housing 12A in which a plurality of terminal receiving portions 21 are formed, and engaging portions 19 and 20 having the same structure as those of the engaging portions 16 and 17 in the connector 11 mentioned above and an engaging recess portion 18B are formed on one side surface 18 of the connector housing 12A.

On the contrary, engaged groove portions 23 and 24 corresponding to a joining groove portion are formed on another side surface 22 of the connector housing 12A at a predetermined interval along a height direction of the connector housing 12A.

A position at which the engaged groove portion 23 is formed corresponds to a position opposite to the engaging portion 19 formed on the side surface 18 in the connector housing 12A. The engaged groove portion 23 corresponds to the engaging portion 16 of the connector 11 in the case of joining the connector 11 to the connector 12, and the structure is made such that the engaging portion 16 is inserted to the engaged groove portion 23 from a lower side, as shown by a single dot chain line in FIG. 1.

The engaged groove portion 23 is structured such that an inverted taper surface 23A engaging with a back surface (a surface opposing to the side surface 15) of the engaging piece 16A and an inverted taper surface 23B engaging with a back surface of the engaging piece 16B are formed so that the inserted engaging portion 16 is not taken out to a side portion. Further, a depth of the engaged groove portion 23 is set to substantially equal to a height between the side surface 15 in the connector 11 and the front end surfaces of the engaging pieces 16A and 16B (a size between the side surface 18 and the front end surfaces of the engaging pieces 19A and 19B).

A position at which the engaged groove portion 24 is formed corresponds to a position opposite to the engaging portion 20 formed on the side surface 18 in the connector housing 12A. Further, the engaged groove portion 24 corresponds to the engaging portion 17 of the connector 11 in the case of joining the connector 11 to the connector 12, and the structure is made such that the engaging portion 17 is inserted to the engaged groove portion 24 from a lower side, as shown by a single dot chain line in FIG. 1.

In the engaged groove portion 24, an inverted taper surface 24A engaging with a back surface of the engaging piece 17A and an inverted taper surface 24B engaging with a back surface of the engaging piece 17B are formed so that the inserted engaging portion 17 is not taken out to a side portion. Further, a depth of the engaged groove portion 24 is set to substantially equal to a height between the side surface 15 in the connector 11 and the front end surfaces of the engaging pieces 17A and 17B (a size between the side surface 18 and the front end surfaces of the engaging pieces 20A and 20B). Further, an erroneous join prevention protruding portion 24C is formed in a bottom portion of the engaged groove portion 24 along a height direction (a groove direction) of the connector housing 12A.

A step portion 22A recessed toward the side surface 18 side from the side surface 22 is formed in a lower portion of the side surface 22 on which the engaged groove portions 23 and 24 are formed. Further, engaging convex portions 22B and 22B engaged with the engaging recess portions 15B and 15B mentioned above are respectively formed in both sides of the upper portion of the side surface 22.

Here, a description will be given of a side surface 29 of the connector 11.

As mentioned above, since the connector 11 and the connector 12 have the same structure, the side surface 29 has the same structure as that of the side surface 22 of the connector 12. That is, as shown in FIG. 1, an engaged groove portion 25 having the same shape as that of the engaged groove portion 23 of the connector 12 and an engaged groove portion 26 having the same shape as that of the engaged groove portion 24 of the connector 12 are formed on the side surface 29.

Next, a description will be given of a method of joining the connector 11 to the connector 12, an operation and an effect thereof.

Figure 2:
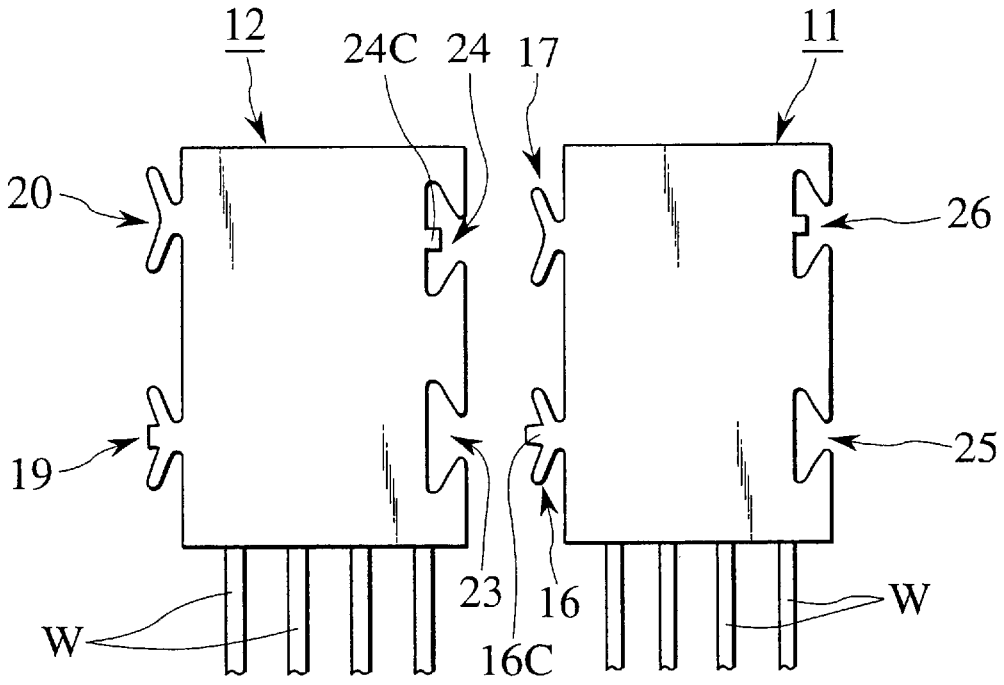
FIG. 2 is a plan view showing a proper joining arrangement of the connectors in accordance with the embodiment.

At first, as shown in FIGS. 1 and 2, the engaging portion 17 of the connector 11 is inserted to the engaged groove portion 24 of the connector 12 at the same time when the engaging portion 16 of the connector 11 is inserted to the engaged groove portion 23 of the connector 12.

At this time, the connector 12 is operated so as to slide the side surface 15 and the side surface 22 toward the upper portion of the connector 11 from the lower portion thereof.

Then, since the guiding taper surfaces 16*a*, 16*b*, 17*a* and 17*b* are formed in the upper portions of the engaging pieces 16A, 16B, 17A and 17B constituting the engaging portions 16 and 17, at an initial time of inserting, these guiding taper surfaces 16*a*, 16*b*, 17*a* and 17*b* are engaged with the lower edges of the inverted taper surfaces 23A, 23B, 24A and 24B of the engaged groove portions 23 and 24 in the connector 12 side.

As a result, the engaging pieces 16A, 16B, 17A and 17B are received within the corresponding engaged groove portion.

Next, when a slide operation is performed so as to lift up the connector 11 with respect to the connector 12, the engaging convex portions 22B and 22B protruded from both sides of the upper portion of the side surface 22 in the connector 12 is engaged with the upper edge of the side surface 15 of the connector 11 and subsequently engaged with the side surface 15.

Figure 4:
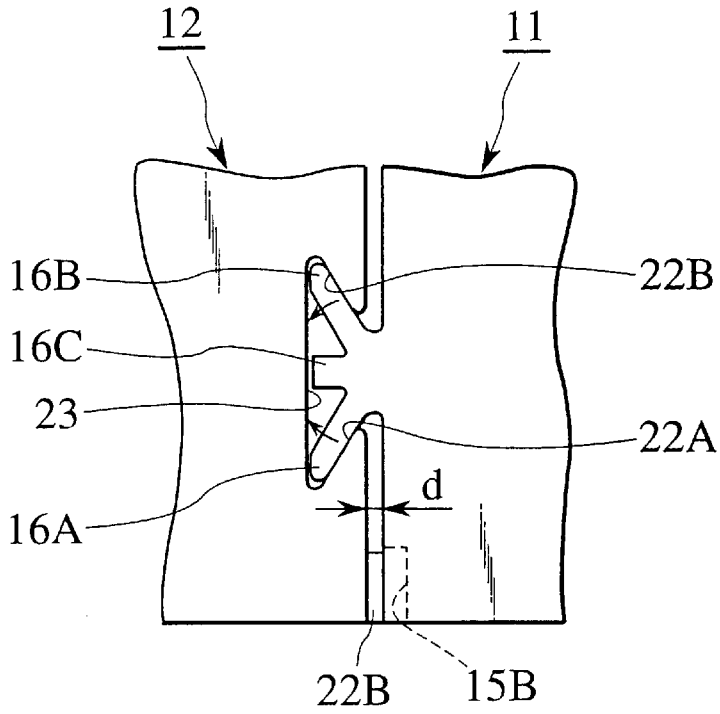
FIG. 4 is a plan view of a main portion in a joining step of the connector in accordance with the embodiment.

At this time, since the engaging convex portions 22B and 22B have a predetermined height, the engaging convex portions 22B and 22B have an operation of moving apart the side surface 15 and the side surface 22 at a predetermined distance d as shown in FIG. 4.

In accordance with this, the engaging pieces 16A, 16B, 17A and 17B engaging with the inverted taper surfaces 23A, 23B, 24A and 24B of the engaged groove portions 23 and 24 are pressed in a direction shown by an arrow in FIG. 4 and elastically deformed.

Figure 5:
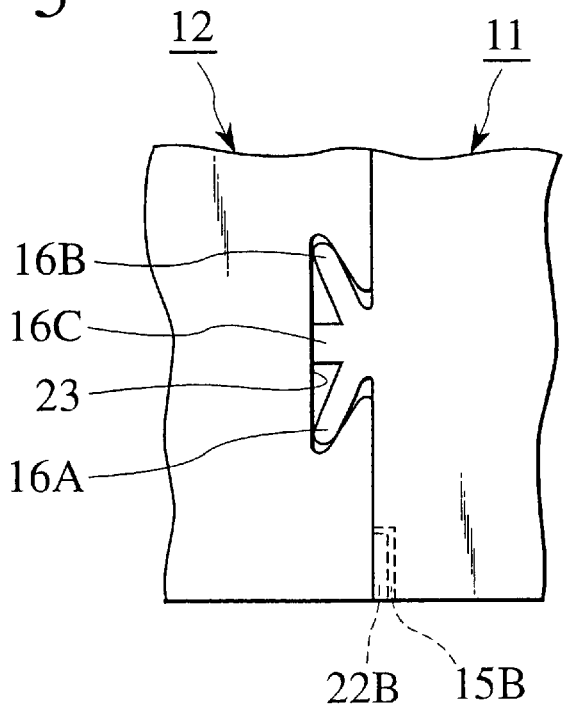
FIG. 5 is a plan view of a main portion in a joining step of the connector.

Next, when further increasing the connector 11 with respect to the connector 12, the engaging recess portions 15B and 15B are aligned with the engaging convex portions 22B and 22B, and the engaging convex portions 22B and 22B are received in the engaging recess portions 15B and 15B as shown in FIG. 5. At the same time, the step portion 15A in the connector 11 side and the step portion 22A in the connector 12 side are brought into contact with each other, and a positioning is performed so that the connector 11 does not move upward any more with respect to the connector 12.

At this time, the inverted taper surface 22A and 22B are pressed back due to a reaction force of the engaging pieces 16A, 16B, 17A and 17B, whereby a distance between the side surface 15 and the side surface 22 is reduced so as to be stabilized in a state shown in FIG. 5. FIGS. 4 and 5 show a relation between the engaging portion 16 and the engaged groove portion 23, however, the same relation can be applied to a relation between the engaging portion 17 and the engaged groove portion 24.

In an arrangement state of the connector 11 and the connector 12 mentioned above, as shown in FIG. 2, since the engaging portion 16 having the erroneous join prevention protruding portion 16C and the engaged groove portion 23 having no erroneous join prevention protruding portion are combined with each other, and the engaged groove portion 24 having the erroneous join prevention protruding portion 24C and the engaging portion 17 having no erroneous join prevention protruding portion are combined with each other, it is possible to join the connector 11 to the connector 12.

Figure 3:
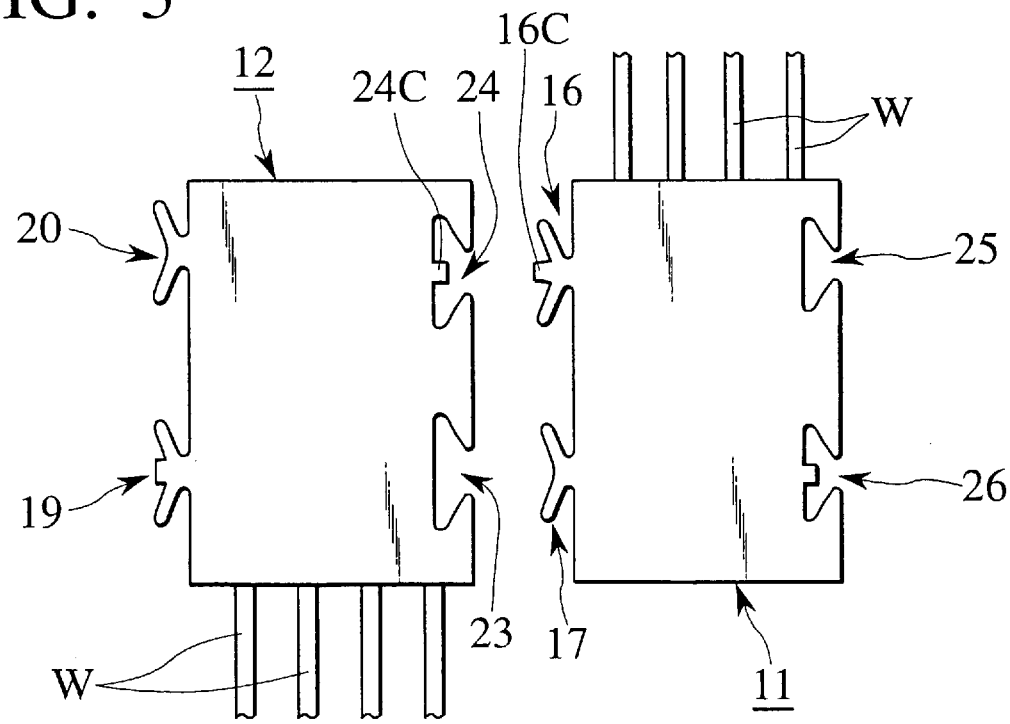
FIG. 3 is a plan view showing an improper joining arrangement of the connectors in accordance with the embodiment.

On the contrary, as shown in FIG. 3, in the case that the direction of the connector 12 is inverted to the connector 11, when it is intended to combine both connectors, the engaging portion 16 corresponds to the engaged groove portion 24, and the erroneous join prevention protruding portion 16C of the engaging portion 16 and the erroneous join prevention protruding portion 24C are interfered with each other, so that a join between the connector 11 and the connector 12 is not established.

As mentioned above, in accordance with the present embodiment, the structure is made such that the erroneous join prevention protruding portion 16C is formed in the engaging portion 16 of the connector 11, the erroneous join prevention protruding portion 16C can be received in the engaged groove portion 23 corresponding to the engaging portion 16 at a time of joining and inserting, the erroneous join prevention protruding portion is not formed in the engaging portion 17 of the connector 11, the erroneous join prevention protruding portion 24C is formed in the engaged groove portion 24 corresponding thereto, and the erroneous join prevention protruding portion 24C is received in the groove between the engaging pieces 17A and 17B of the engaging portion 17.

It is possible to realize a joining structure of a connector which can securely and effectively prevent a play or the like from being generated, can effectively prevent an erroneous join in the case that the connectors have different longitudinal directions in a joining state, and can smoothly and securely perform a joining operation of the connector, on the basis of a simple structure.

In this case, in the present embodiment, the connector 11 and the connector 12 are set to have the same shape, however, the structure is not limited to this, it is possible to join connectors having different shapes and structures as far as the engaging portion and the engaged groove portion have the corresponding positional relation.

For example, the structure may be made such as to join the connectors having different number of connectable wire harnesses W in the connectors to be mutually joined.

Further, in accordance with the present embodiment, the two series of combined connector is obtained by the joining structure, however, the structure can be made such that a multiple series of combined connector more than two is obtained.

Figure 6:
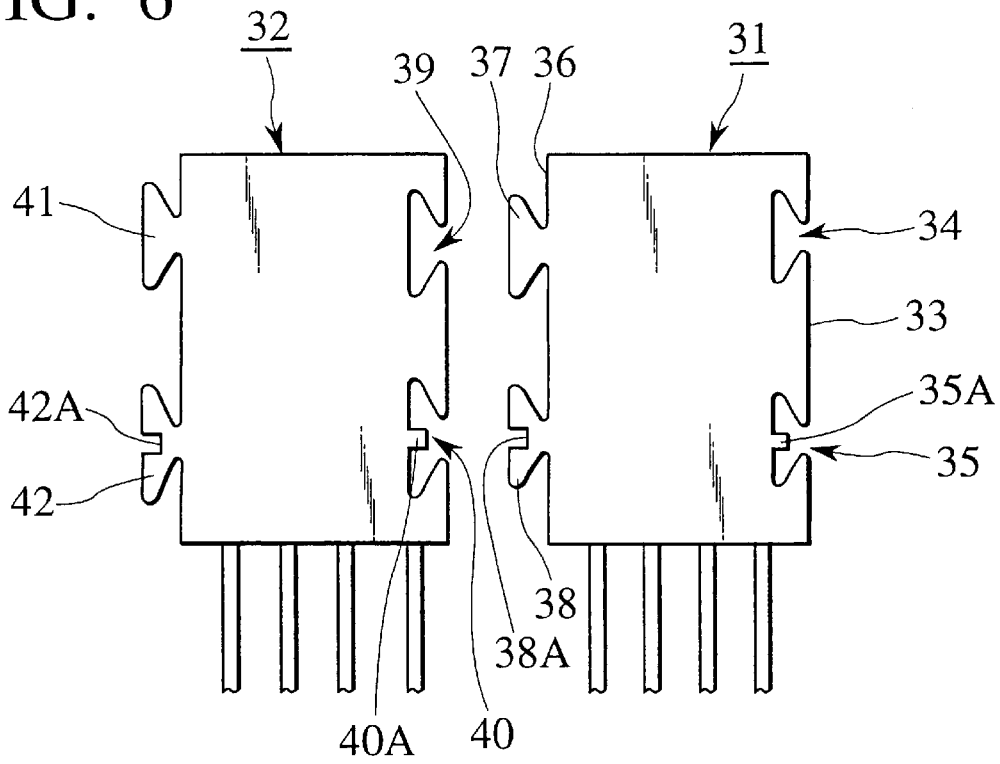
FIG. 6 is a plan view of a joining structure of a connector in accordance with a second embodiment of the present invention.

Next, a description will be in detail given of a second embodiment of a joining structure of a connector in accordance with the present invention with reference to FIG. 6.

As shown in FIG. 6, in accordance with the present embodiment, the structure is made such that one connector 31 is joined to another connector 32, and is basically the same as the structure of the first embodiment. Engaged groove portions 34 and 35 are formed on one side surface 33 of the connector 31 and engaging portions 37 and 38 are formed on another side surface 36.

The engaged groove portions 34 and 35 are structured such that a width of a groove opening portion is formed narrower than a width of a groove bottom portion in the same manner as the shape of the engaged groove portion in accordance with the first embodiment mentioned above. Further, an erroneous join prevention protruding portion 35A is formed in a bottom portion of one engaged groove portion 35 among the engaged groove portions 34 and 35 along a vertical direction of the connector.

The engaged groove portions 37 and 38 are structured such that a width of a base portion in a side surface 36 side is set to be narrow and a width in a front end side is set to be wide and a cross sectional shape is formed in a substantially equilateral triangle shape. The engaging portion 37 is formed at a corresponding position in an opposite side of the engaged groove portion 34 mentioned above in the connector 31, and the engaging portion 38 is formed at a corresponding position opposite to the engaged groove portion 35. Further, a protrusion receiving groove portion 38A is formed at a center in a width direction of the front end surface of the engaging portion 38 along a vertical direction.

The connector 32 has substantially the same structure as that of the connector 31, and engaged portions 39 and 40 corresponding to the engaged grove portions 34 and 35, and engaging portions 41 and 42 corresponding to the engaging portions 37 and 38 are formed therein. In this case, the other structures in the present embodiment are the same as those of the first embodiment mentioned above.

In the present embodiment mentioned above, it is possible to intend to join both of the connectors 31 and 32 by inserting the joining portions 37 and 38 of the connector 31 to the engaged groove portions 39 and 40 of the connector 32.

Then, since an erroneous join prevention protruding portion 40A is protruded in a bottom portion of the engaged groove portion 40, it is possible to effectively prevent an erroneous join by preventing the engaging portion 37 of the connector 31 from being inserted.

In this case, also in accordance with the present embodiment, the connector 31 and the connector 32 are set to have the same shape, however, the structure is not limited to this, it is possible to join connectors having different shapes and structures with each other as far as the engaging portion and the engaged groove portion have the corresponding positional relation.

Further, also in accordance with the present embodiment, the two series of combined connector is obtained by the joining structure, however, a multiple series of combined connector more than two can be obtained.

Figure 7:
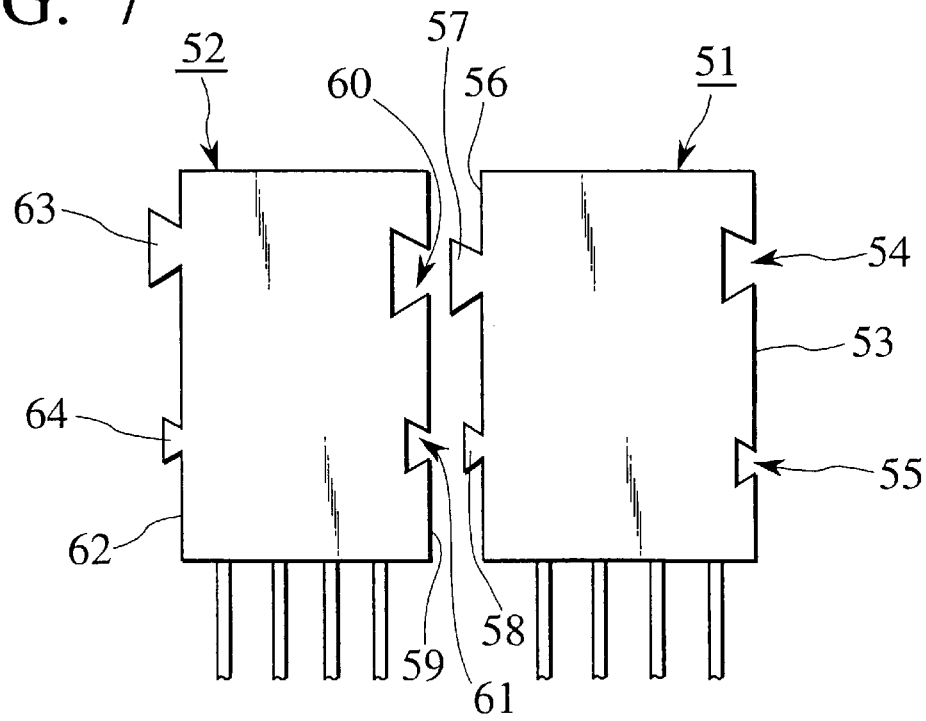
FIG. 7 is a plan view of a joining structure of a connector in accordance with a third embodiment of the present invention.
Figure 8:
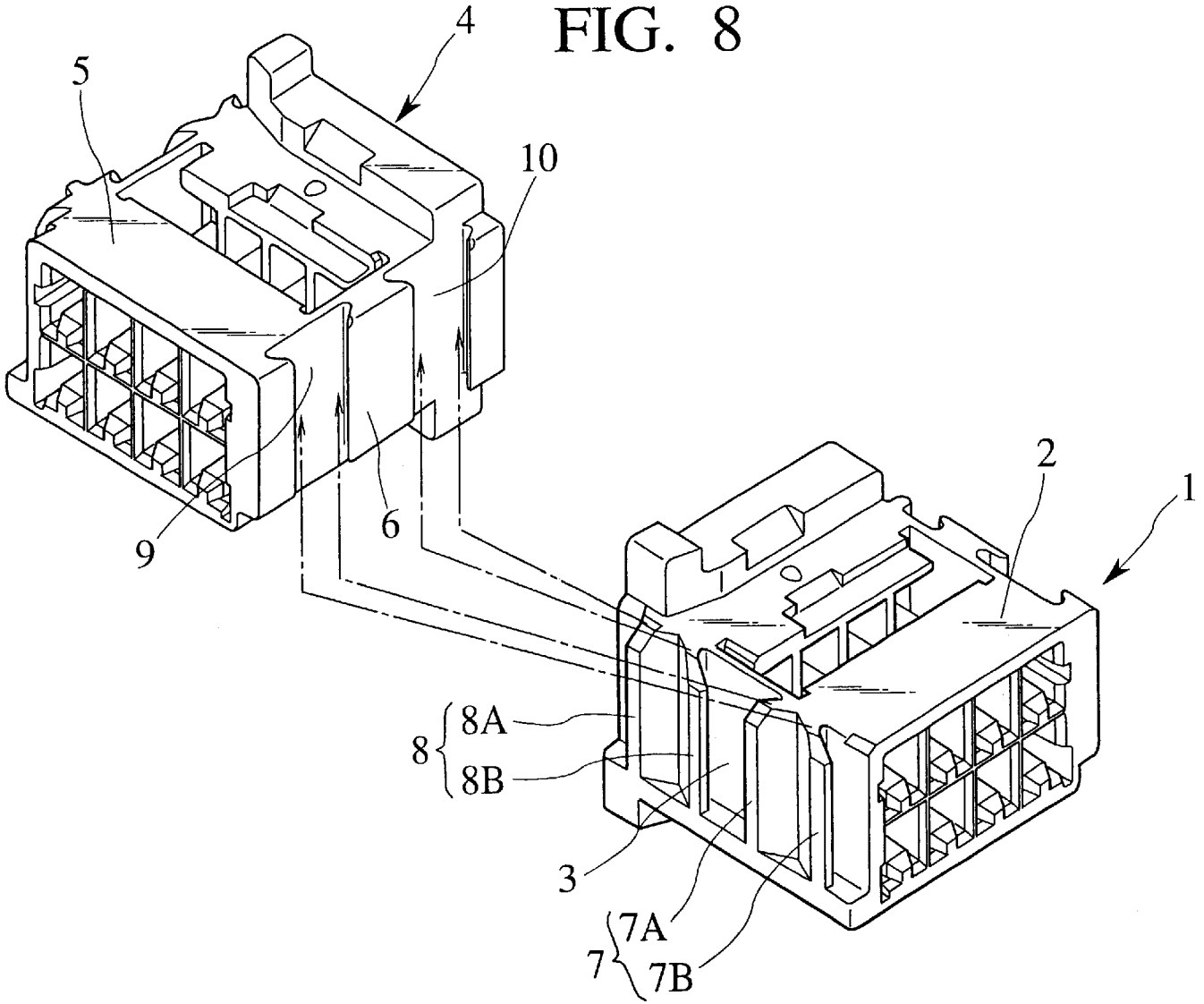
FIG. 8 is a perspective view showing a joining structure of a connector in accordance with a consideration of the inventors of the present invention.
Figure 9:
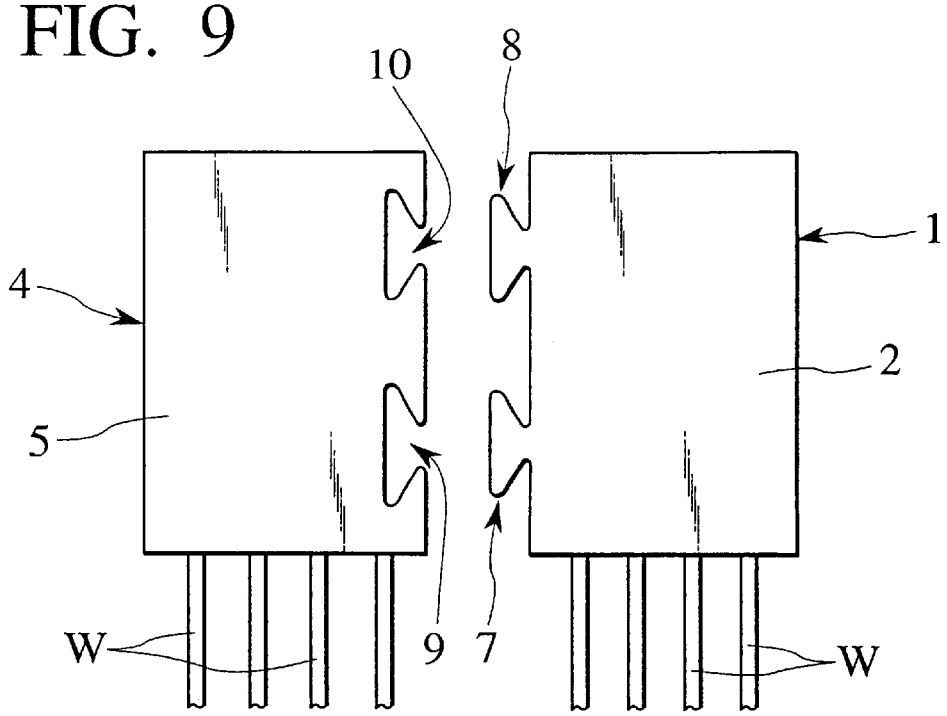
FIG. 9 is a plan view showing a proper joining arrangement of the connectors.
Figure 10:
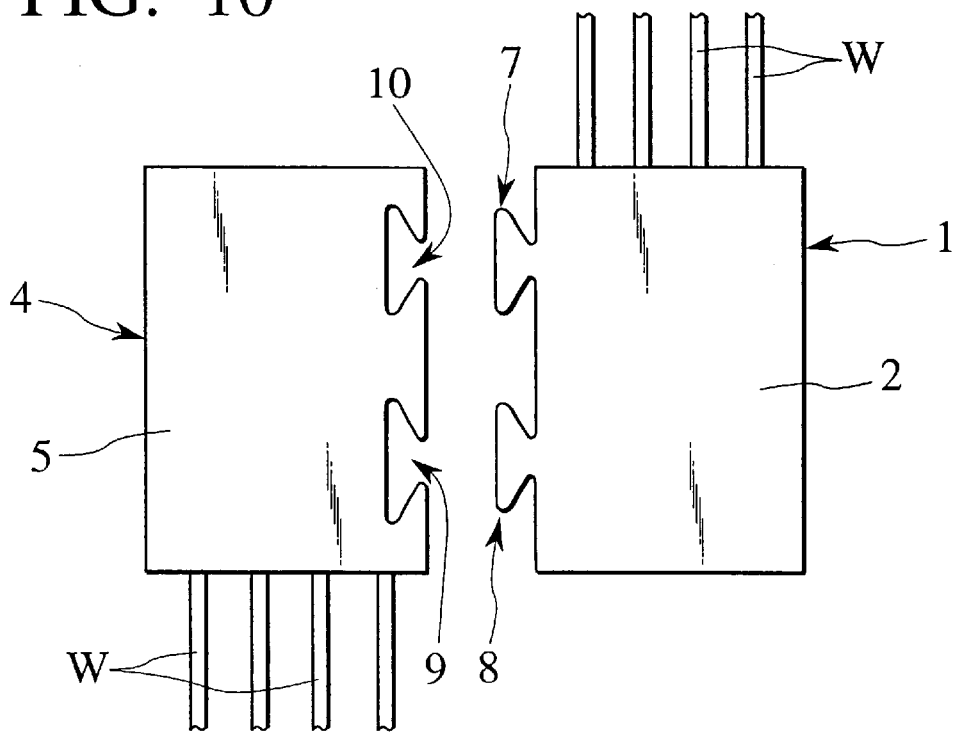
FIG. 10 is a plan view showing an improper joining arrangement of the connectors.

Next, a description will be in detail given of a third embodiment of a joining structure of a connector in accordance with the present invention with reference to FIG. 7.

As shown in FIG. 7, in accordance with the present embodiment, the structure is made such that a connector 51 is joined to a connector 52, and is basically the same as the structure of the first embodiment. An engaged groove portion 54 having a long width and an engaged groove portion 55 having a short width are formed on one side surface 53 of the connector 51 and an engaging portion 57 having a long width and an engaging portion 58 having a short width are formed on another side surface 56.

Another connector 52 has substantially the same structure as that of the connector 51, in which engaged groove portions 60 and 61 having the same structure as the engaged groove portions 54 and 55 mentioned above are formed on one side surface 59, and engaging portions 63 and 64 having the same structure as the engaging portions 57 and 58 mentioned above are formed on another side surface 62.

In the third embodiment having the structure mentioned above, it is set such that the engaging portion 57 having a long width can be inserted to the engaged groove portion 60 having a long width, the engaging portion 58 having a short width can be inserted to the engaged groove portion 61 having a short width, and the engaging portion 57 having a long width can not be inserted to the engaged groove 61 having a short width. In this case, the other structures of the present embodiment are the same as those of the first embodiment mentioned above.

In accordance with the present embodiment mentioned above, it is possible to intend to join both of the connectors 51 and 52 by inserting the engaging portions 57 and 58 of the connector 51 in correspondence to the engaged groove portions 60 and 61 of the connector 52, and the join between the connector 51 and the connector 52 can be allowed only in the corresponding relation between the engaging portions 57 and 58 and the engaged groove portions 60 and 61, so that it is possible to effectively prevent an erroneous join by preventing the engaging portion 58 of the connector 51 from being inserted to the engaged groove portion 61 of the connector 52.

Further, also in accordance with the present embodiment, the connector 51 and the connector 52 are set to have the same shape, however, the structure is not limited to this, it is possible to join connectors having different shapes and structures to each other by corresponding the engaging portion to the engaged groove portion in the positional relation.

Further, also in the present embodiment, the two series of combined connector is obtained by the joining structure, however, a multiple series of combined connector more than two can be obtained.

As mentioned above, each of the embodiments is described, however, the present invention can be variously modified in accordance with the aspects of the structure.

For example, in each of the embodiments mentioned above, there is employed the structure in which two sets of engaging portions and engaged groove portions are formed on the side surface of the respective connectors, however, the structure may be made such that three of more sets of engaging portions and engaged groove portions are respectively formed on one side surface.

Further, in the first and second embodiments mentioned above, the erroneous join prevention protruding portions 16C, 24C and 40A are formed along the height direction of the connector so as to have a length substantially equal to the height, however, since it is sufficient to substantially prevent the erroneous join, for example, a projection-like portion is formed by separating the side surface of the connector into upper and lower portions.

In addition, it is of course that the present invention can be realized by variously modifying the structure within a range of the technical feature of the present invention.

What is claimed is:

1. A joining structure of a connector comprising:

one connector having a plurality of engaging portions; and another connector having the same number of engaging portions as the number of the plurality of engaging portions in the one connector, the plurality of engaging portions in the one connector and the plurality of engaging portions in the another connector being mutually corresponded so as to form a plurality of engaging pairs, wherein the plurality of engaging portions in the one connector and the plurality of engaging portions in the another connector respectively have shapes so that respective engaging portions can correspondingly engage with each other so as to form the plurality of engaging pairs in the case that the one connector and the another connector are joined in a proper direction, and at least one of pairs between the plurality of engaging portions in the one connector and the plurality of engaging portions in the another connector can not engage with each other in the case that the one connector and the another connector are joined in an improper direction, wherein the one connector has a positioning recess portion, the another connector has a positioning protruding portion, the plurality of engaging portions in the one connector have an engaging piece, and the plurality of engaging portions in the another connector have a groove portion corresponding to the engaging piece, and wherein as the one connector and the another connector are adapted to be joined in the proper direction, the engaging piece is pressure contacted to the side wall of the groove portion so as to be elastically deformed in a state that the positioning protruding portion rides over the side surface of the one connector so as to engage with the side surface, and then the engaging piece elastically keeps an engaging state between the positioning recess portion and the positioning protruding portion in a state that the positioning recess portion and the positioning protruding portion are engaged with each other.

2. A joining structure of a connector as claimed in claim 1, wherein at least one of the plurality of engaging portions in the one connector has a protruding portion, at least one of the plurality of engaging portions in the another connector has a protruding portion, and the protruding portion in the one connector and the protruding portion in the another connector are interfered with each other in the case that the one connector and the another connector are joined in the improper direction.

3. A joining structure of a connector as claimed in claim 2, wherein the protruding portion in the one connector and the protruding portion in the another connector are not interfered with each other in the case that the one connector and the another connector are joined in the proper direction.

4. A joining structure of a connector as claimed in claim 3, wherein the plurality of engaging portions in the one connector are provided in a connector housing of the one connector, and have two engaging pieces obliquely provided so as to mutually move apart from the connector housing, and the protruding portion in the one connector is provided between the two engaging pieces.

5. A joining structure of a connector as claimed in claim 4, wherein the plurality of engaging portions in the another connector are provided in a connector housing of the another connector, and have groove portions corresponding to the two engaging pieces of the one connector, and the protruding portion in the another connector is provided between the groove portions.

6. A joining structure of a connector as claimed in claim 1, wherein at least one of the plurality of engaging portions in the one connector has a flat surface portion, at least one of the plurality of engaging portions in the another connector has a protruding portion, and the flat surface in the one connector and the protruding portion in the another connector are interfered with each other in the case that the one connector and the another connector are joined in the improper direction.

7. A joining structure of a connector as claimed in claim 6, wherein a recess portion is formed in at least one of the flat surface portions in the one connector, and the recess portion of the flat surface portion in the one connector corresponds to the protruding portion in the another connector in the case that the one connector and the another connector are joined in the proper direction.

8. A joining structure of a connector as claimed in claim 7, wherein the plurality of engaging portions in the one connector are provided in a connector housing of the one connector, each engaging portion having two engaging pieces obliquely provided so as to mutually move apart from the connector housing, and the flat surface portion in the one connector is provided so as to connect between the two engaging pieces.

9. A joining structure of a connector as claimed in claim 8, wherein the plurality of engaging portions in the another connector are provided in a connector housing of the another connector, and have groove portions corresponding to the two engaging pieces of the one connector, and the protruding portion in the another connector is provided between the groove portions.

10. A joining structure of a connector as claimed in claim 1, wherein at least one of the plurality of engaging portions in the one connector and at least one of the plurality of engaging portions in the another connector have different sized with each other.

11. A joining structure of a connector as claimed in claim 10, wherein the plurality of engaging portions in the one connector has engaging pieces and the plurality of engaging portions in the another connector has groove portions corresponding to the engaging pieces.

12. A joining structure of a connector as claimed in claim 1, wherein the one connector and the another connector are substantially conformable.

* * * * *

UNITED STATES PATENT AND TRADEMARK OFFICE

CERTIFICATE OF CORRECTION

PATENT NO. : 6,332,813 B1
DATED : December 25, 2001
INVENTOR(S) : Toshiaki Okabe and Tetsuya Yamashita It is certified that error appears in the above-identified patent and that said Letters Patent is hereby corrected as shown below:

Column 12,
Line 3, "sized" should read -- sizes --.

Signed and Sealed this

Twenty-first Day of May, 2002

*Attest:*

*Attesting Officer*

JAMES E. ROGAN
*Director of the United States Patent and Trademark Office*